US005738588A

United States Patent [19]

Esser

[11] Patent Number: 5,738,588

[45] Date of Patent: Apr. 14, 1998

[54] PLAYING FIELD BOUNDARY

[75] Inventor: Ralf Esser, Hennef, Germany

[73] Assignee: Erhard Sport International GmbH & Co., Rothenberg o.d. Tauber, Germany

[21] Appl. No.: 730,898

[22] Filed: Oct. 18, 1996

[30] Foreign Application Priority Data

Oct. 21, 1995 [DE] Germany ..... 195 39 280.9

[51] Int. Cl.[6] ..... A63G 33/00

[52] U.S. Cl. ..... 472/92; 472/94; 256/24; 256/65

[58] Field of Search ..... 472/92, 94; 256/24, 256/59, 65; 473/469, 415

[56] References Cited

U.S. PATENT DOCUMENTS 4,930,752 6/1990 Wolper, Jr. ..... 256/24 X 5,312,109 5/1994 Cagle ..... 472/94 X 5,622,021 4/1997 Bookout ..... 472/92 X

FOREIGN PATENT DOCUMENTS 2 417 998 11/1979 France .

*Primary Examiner*—Kien T. Nguyen

*Attorney, Agent, or Firm*—Browdy and Neimark

[57] ABSTRACT

In a playing field boundary, particularly for ball games, that encompasses a peripheral, vertical band comprising a plurality of plate-like band elements that can be connected to one another, in order to make the boundary easy to transport and assemble, as well as highly stable in the assembled state, it is provided that the band elements (1) can be connected to one another form-fittingly, and that a peripheral, tensible belt arrangement (belt 28) is provided which encompasses the band elements (1).

13 Claims, 2 Drawing Sheets

PLAYING FIELD BOUNDARY

Figure 1:
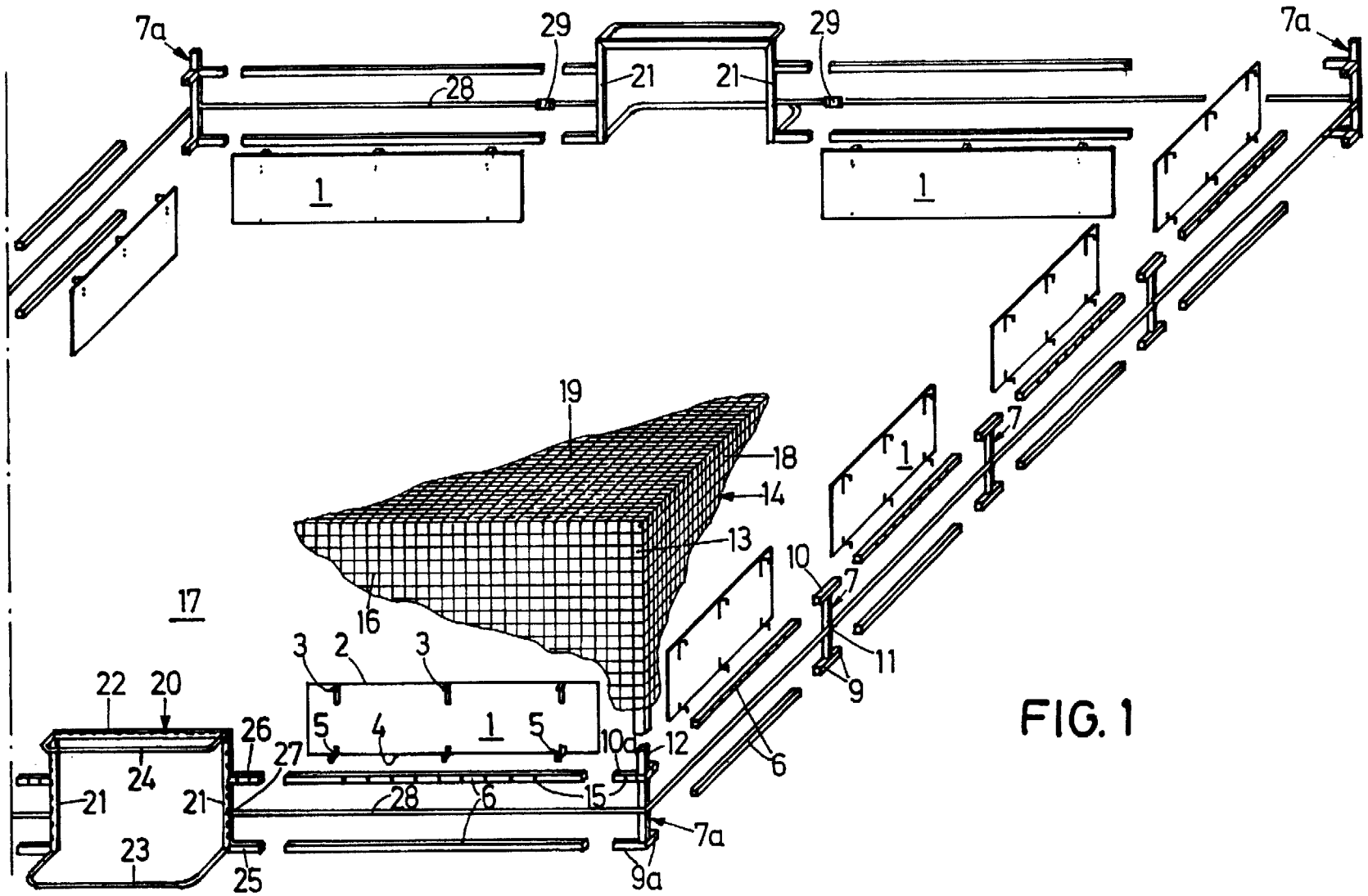

The invention relates to a playing field boundary, particularly for ball games that encompasses a peripheral, vertical band comprising a plurality of plate-like band elements that can be connected to one another.

Playing field boundaries of this type are used in particular if a playing field is not constructed to be permanent and stationary, but is only to be set up temporarily for shows or competitions. In these cases, it is not possible to anchor the band elements to the ground or floor, for example in ice hockey rinks, because damaging the ground or floor is generally prohibited, or this type of securing is simply not possible because the surface is paved or covered with tar. The same applies for indoor floors.

It is already known to provide bands with heavy supports so that the band elements can be erected due to their own weight. This type of construction is, however, extremely disadvantageous if the playing field boundary under consideration is intended to be transportable, in which instance comparatively lightweight and low-volume vehicles are to be used for transporting the playing field boundary from location to location for show events.

With this point in mind, the object of the invention is to configure a playing field boundary of the type mentioned at the outset such that it can be transported and set up relatively simply, yet possesses great stability when set up and, moreover, conveys the impression of a competition arena, creating a certain sporting or competitive mood.

In accordance with the invention, the object is accomplished by the fact that the band elements can be indirectly or directly connected to one another form-fittingly, and that a peripheral, tensible belt arrangement is provided which encompasses the band elements. Hereinafter the term belt arrangement encompasses both belts in a narrower sense and corresponding means, such as cables, chains or the like. Belts in the narrower sense are, however, advantageous because commercially-available tensing elements that permit the application of high tension are available for these belts.

With the configuration of the invention, the individual band elements can be assembled quickly without necessitating support toward the outside, with the setup and tensioning of the belt providing great stability for the overall system.

In a further embodiment of the invention, it is provided that the individual band elements are connected form-fittingly to one another by way of connecting elements; here belt-guiding loops can advantageously be disposed on the outside of the connecting elements. The connecting elements can have vertical supports and horizontal connecting sleeves.

The band elements can advantageously be connected form-fittingly with horizontal beams that are dimensioned such that they extend form-fittingly into the horizontal sleeves of the connecting elements. Correspondingly, the connecting elements are first connected to each other by way of the inserted beams, and are subsequently suspended. This can be advantageously effected by securing hooks that form-fittingly extend around the beams to the outside of the band elements.

A part of the connecting elements can be configured as corner elements comprising two horizontal connecting sleeves at a right angle to one another.

The connecting elements advantageously have connecting sleeves, in the form of sleeve projections, at the upper and lower end, respectively, of the vertical section.

An upwardly-extending sleeve projection can be respectively provided at the corner elements for form-fitting reception of a vertical corner supporting beam; a net can be tensed over the corner supporting beams. The net can advantageously extend the playing field boundary vertically, on the one hand, while covering the playing surface horizontally on the other. As a result, the ball is practically continuously in play, greatly accelerating the game and making it more exciting. Furthermore, the closed net creates a very intense visual impression, conveying the feeling of a "battle arena."

In an embodiment of the playing field as a soccer, handball or hockey field, a part of the playing field boundary is formed by goals, in which instance sleeve projections are advantageously attached to the lateral goalposts for receiving beams of the band elements, or for the beam elements. A fastening device for the encompassing belt arrangement is also advantageously provided on the goalposts.

A U-shaped yoke can extend toward the back from the lower end of each post in order to stabilize the goal.

Net suspension eyelets are disposed on the respectively upper beams and/or sleeve projections in order to secure the net, so the net can be secured all the way around by means of net hooks.

Figure 3:
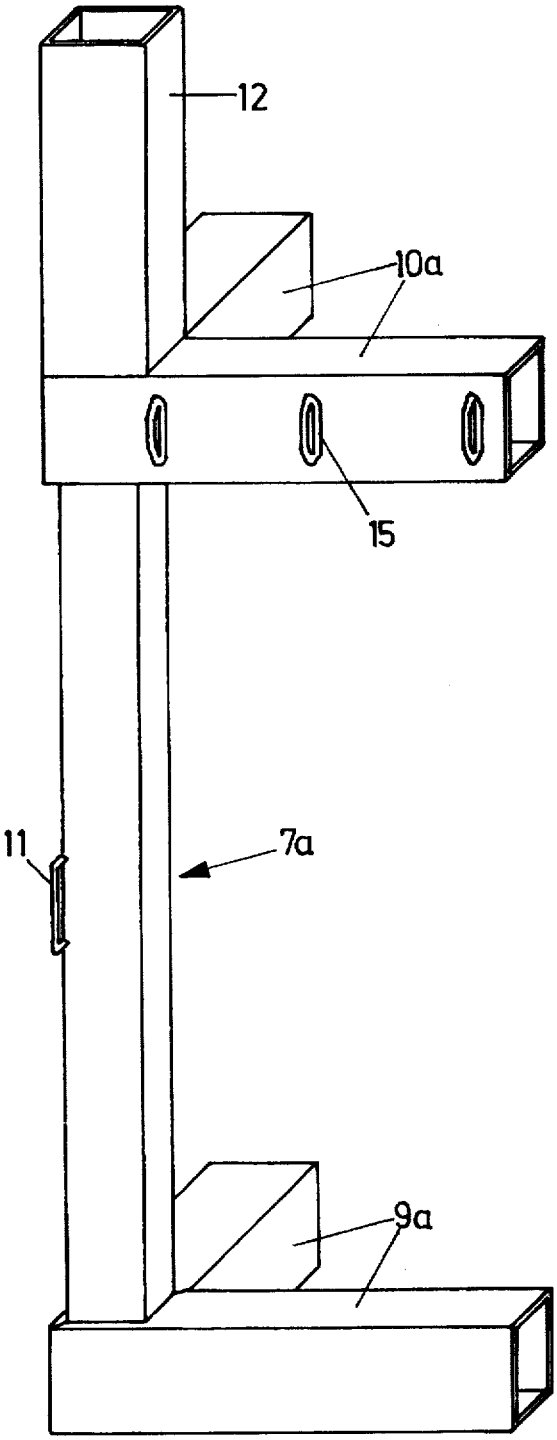
Figure 2:
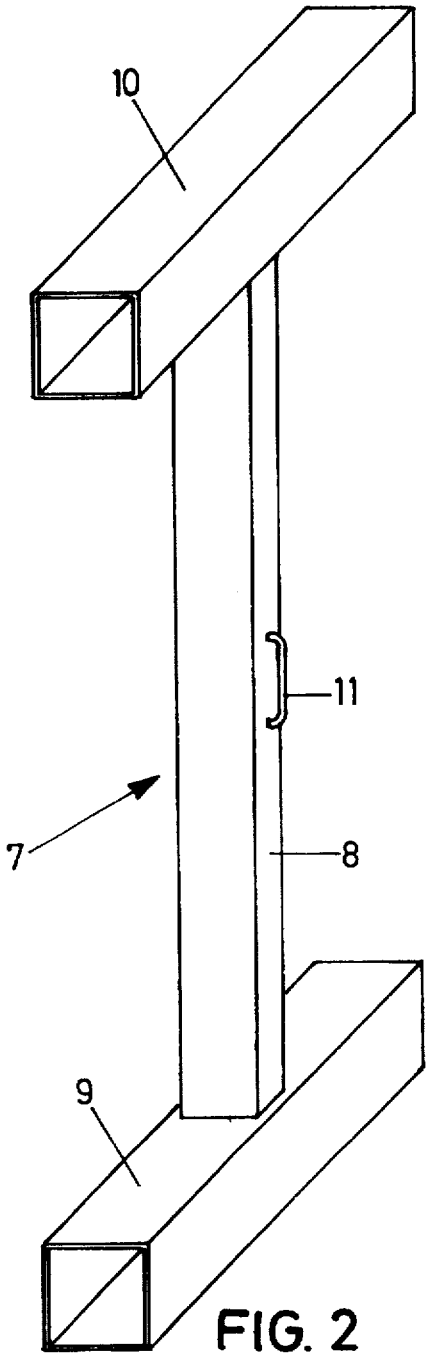

The description is described in detail below in conjunction with a preferred embodiment, with reference to the drawing. Shown are in:

FIG. 1 an exploded-type view in perspective of a playing field boundary of the invention, FIG. 2 a view in perspective of a connecting element, and FIG. 3 a view in perspective of a corner connecting element.

A playing field boundary of the invention includes a plurality of plate-like band elements 1, hook arrangements 3 attached by means of screws in the region of the upper band edge 2, and hook arrangements 5 attached by means of screws in the lower band edge 4; the hook arrangements are configured such that they can extend form-fittingly around horizontal beams 6 of glued and impregnated wood. The beams could also be formed from aluminum profiles.

Connecting elements 7 encompass a vertical section 8, to whose lower end a horizontal sleeve projection 9 is welded and to whose upper end a further horizontal sleeve projection 10 is welded. The connecting elements 7 comprise metal, e.g., steel profile parts. A belt-tensing and guiding loop 11 is disposed approximately in the center and on the outside of the vertical section 7 [sic].

A part of the connecting elements **7*a* is configured as corner elements, with the upper and lower sleeve projections 9*a* and 10*a*, respectively, forming a right angle; a vertical sleeve projection 12 that is open to the top and extends away as an extension of the vertical section 7 [sic] serves to receive a vertical beam 13 in order to tense a net 14**.

Net suspension eyelets 15 are provided on the outside of the respectively upper beams and sleeve projections 10 or **10*a***, so that a net clamped over the vertical beams can be secured there.

The net 14 shown partially in the drawing comprises vertical parts 16 along the end sides of the playing field 17, and vertical sections 18, which extend in the direction of the longitudinal sides of the playing field 17, as well as an upper, horizontal cover section 19.

Goals 20 comprising two posts 21 and a transverse batten 22 are disposed at the end sides of the playing field. A U-shaped yoke 23 that serves to hold the net and stabilize the goal 20 is secured to the lower end of the posts 21. A net holding yoke 24 is secured to the upper end of the posts 21. A sleeve projection 25 that extends to the side is additionally secured to the lower post 21. Corresponding sleeve projections 26 which are offset in height are provided in the direction of the upper end.

A securing device 27 for a belt band 28 is embodied between the sleeve projections 25 and 26; the belt band extends from the post 21 of the one goal, around an entire half of the playing field boundary, and up to the post 21 of the respectively opposite goal. A belt-tensing arrangement 29 configured in the manner of commercially-available arrangements and operated by means of a ratchet mechanism is disposed between the posts in order to exert considerable tensing forces.

A corresponding belt band 28 extends from one post 21 of the one goal, along the opposite side, up to the respectively other post 21 of the opposite goal 20, where a belt-tensing arrangement 29 is also disposed. Correspondingly, the entire arrangement can be tensed along its perimeter.

A playing field boundary of the invention is assembled as follows: the horizontal beams 6 are inserted into the horizontal sleeve projections 9 or 9*a* and 10 or 10*a* of the connecting elements 7 or 7*a*, and the sleeve projections 25 and 26 of the goals 20 are inserted until they come into contact. The plate-like band elements 1 are suspended in the respectively upper or lower horizontal beam 6 by way of the hook arrangements 3 or 5. The belts 28 are guided through the belt-guiding loops 11 to extend, as described above, from post to post. Then tensing is effected by the tensing devices 29, thus stabilizing the entire playing field boundary without necessitating puncturing of the ground or floor.

Now the vertical beams 13 are inserted into the vertical sleeve projections 12 of the corner connecting elements 7*a*, and the net 14 is tensed over them. The lower edge of the net 14 is respectively connected to the net suspension eyelets 15 by hooks that are not shown in the drawing.

I claim:

1. A playing field boundary for ball games comprising:

a peripheral, vertical band including a plurality of band elements (1) indirectly or directly connectable to one another form-fittingly and a peripheral, tensible belt arrangement (28) encompassing the band elements (1);

wherein the band elements (1) are connected form-fittingly to one another by connecting elements (7, 7*a*);

wherein belt-guiding loops (11) are disposed on an outwardly-facing side of the connecting elements (7, 7*a*).

2. A playing field boundary for ball games comprising:

a peripheral, vertical band including a plurality of band elements (1) indirectly or directly connectable to one another form-fittingly; and a peripheral, tensible belt arrangement (28) encompassing the band elements (1);

wherein the band elements (1) are connected form-fittingly to one another by connecting elements (7, 7*a*);

wherein the connecting element (7, 7*a*) have vertical supports (8) and horizontal sleeve projections as connecting sleeves (9, 10, 9*a*, 10*a*).

3. A playing field boundary for ball games comprising:

a peripheral, vertical band including a plurality of band elements (1) indirectly or directly connectable to one another form-fittingly; and a peripheral, tensible belt arrangement (28) encompassing the band elements (1);

wherein the band elements (1) can be form-fittingly connected with horizontal beams (6), wherein the beams (6) are dimensioned such that they extend form-fittingly into horizontal connecting sleeves (9, 10, 9*a*, 10*a*) of the connecting elements (7, 7*a*).

4. Playing field boundary according to claim 3, wherein hooks (3, 5) that extend form-fittingly around the beams (6) are disposed on a outside of the band elements (1).

5. A playing field boundary for ball games comprising:

a peripheral, vertical band including a plurality of band elements (1) indirectly or directly connectable to one another form-fittingly and a peripheral, tensible belt arrangement (28) encompassing the band elements (1);

wherein the band elements (1) are connected form-fittingly to one another by connecting elements (7, 7*a*);

wherein a part of the connecting elements (7*a*) is configured as corner elements, wherein two horizontal connecting sleeves (9*a*, 10*a*) are at a right angle to one another.

6. Playing field boundary according to claim 5, wherein the corner elements (7*a*) include an upwardly-extending sleeve projection (12) for form-fitting reception of a vertical corner support beam (13).

7. A playing field boundary for ball games comprising:

a peripheral, vertical band including a plurality of band elements (1) indirectly or directly connectable to one another form-fittingly; and a peripheral, tensible belt arrangement (28) encompassing the band elements (1);

wherein the band elements (1) are connected form-fittingly to one another by connecting elements (7, 7*a*);

wherein the connecting elements (7, 7*a*) have a sleeve projection (9, 10, 9*a*, 10*a*) at the upper and lower end, respectively, of a vertical support (8).

8. Playing field boundary according to claim 7, wherein a net (14) is tensed over orner support beams (13).

9. Playing field boundary according to claim 8, wherein the net extends the playing field boundary vertically and covers a playing surface (17) horizontally.

10. Playing field boundary according to claim 8, wherein a belt-fastening device (27) is provided on the outside of each goalpost (21).

11. Playing field boundary according to claim 8, wherein net suspension eyelets are disposed on upper beam (6) or sleeve projection (10, 10*a*).

12. A playing field boundary for ball games comprising:

a peripheral, vertical band including a plurality of band elements (1) indirectly or directly connectable to one another form-fittingly; and a peripheral, tensible belt arrangement (28) encompassing the band elements (1);

wherein a part of the playing field boundary is formed by goals (20), wherein sleeve projections (26) are attached to lateral goalposts (21) to receive beams (6) in order of the band elements.

13. Playing field boundary according to claim 12, wherein a U-shaped yoke (23) extends toward the back from the lower end of each post (21).

* * * * *